United States Patent [19]

Giolitti

[11] 4,434,735

[45] Mar. 6, 1984

[54] MOTION CONVERSION MECHANISM FOR EFFECTING SEWING MACHINE FEED DOG CONTROL

[75] Inventor: Nicolò Giolitti, Ivrea, Italy

[73] Assigneè: Vigorelli Genova S.p.A., Genova-Sestri, Italy

[21] Appl. No.: 320,658

[22] Filed: Nov. 12, 1981

[30] Foreign Application Priority Data

Dec. 9, 1980 [IT] Italy ..... 68868 A/80

[51] Int. Cl.[3] ..... D05B 69/02

[52] U.S. Cl. ..... 112/220; 112/158 B; 112/158 E; 112/323

[58] Field of Search ..... 112/220, 323, 158 B, 112/158 E, 158 R

[56] References Cited

U.S. PATENT DOCUMENTS 4,086,861 5/1978 Ketterer et al. ..... 112/158 E 4,265,188 5/1981 Suzuki et al. ..... 112/158 B 4,336,762 6/1982 Giolitti ..... 112/158 E

*Primary Examiner*—Peter P. Nerbun

*Attorney, Agent, or Firm*—Merriam, Marshall & Bicknell

[57] ABSTRACT

A sewing machine is described comprising a mechanism arranged to convert movement signals generated by a decoder unit into movements of a feed dog for the fabric with the main characteristic of the machine being that said mechanism comprises a plurality of levers; a selector unit which is controlled by the decoder unit and selects one of said levers, to place this latter in a working position; a member angularly coupled to a control shaft for the dog and angularly positionable in a predetermined angular position by the selected lever; and a dragging element controlled by said decoder unit and arranged to move the member from its predetermined angular position towards an angular reference position.

17 Claims, 19 Drawing Figures

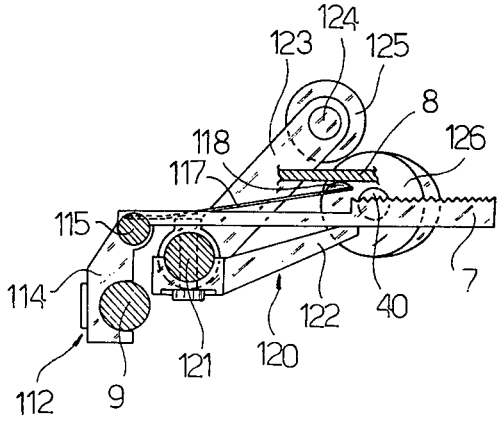
Fig. 9
Fig. 10
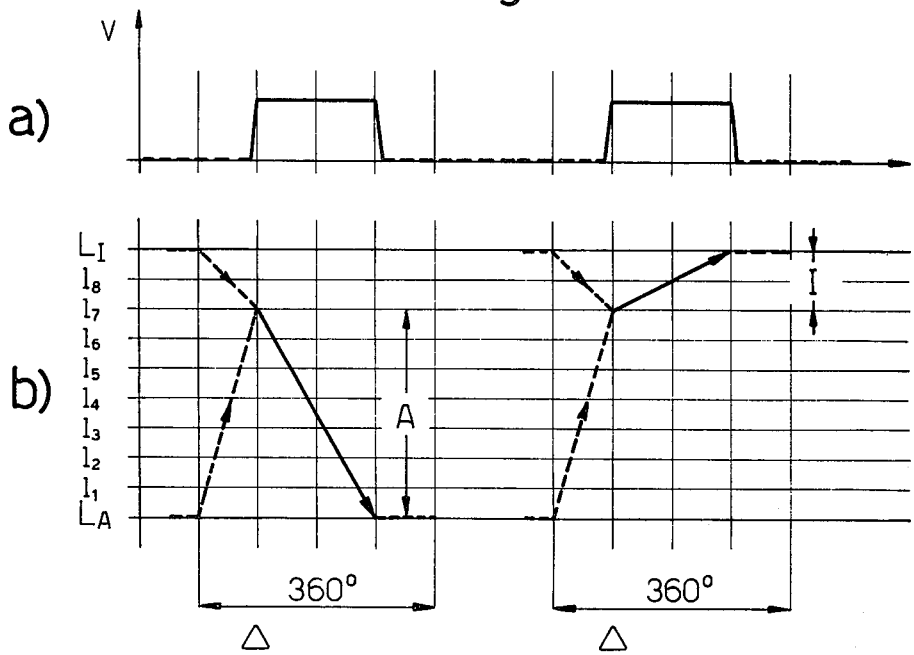

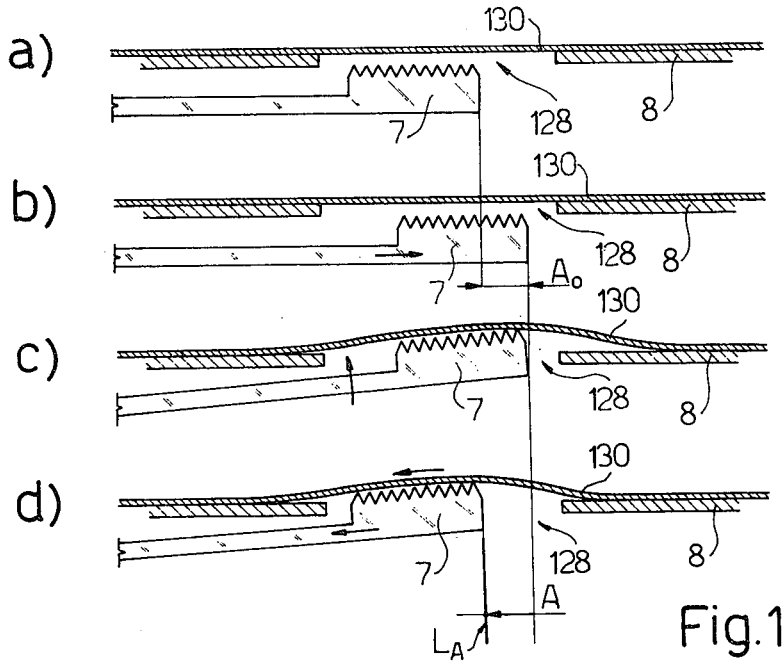
Fig.11
Fig.12
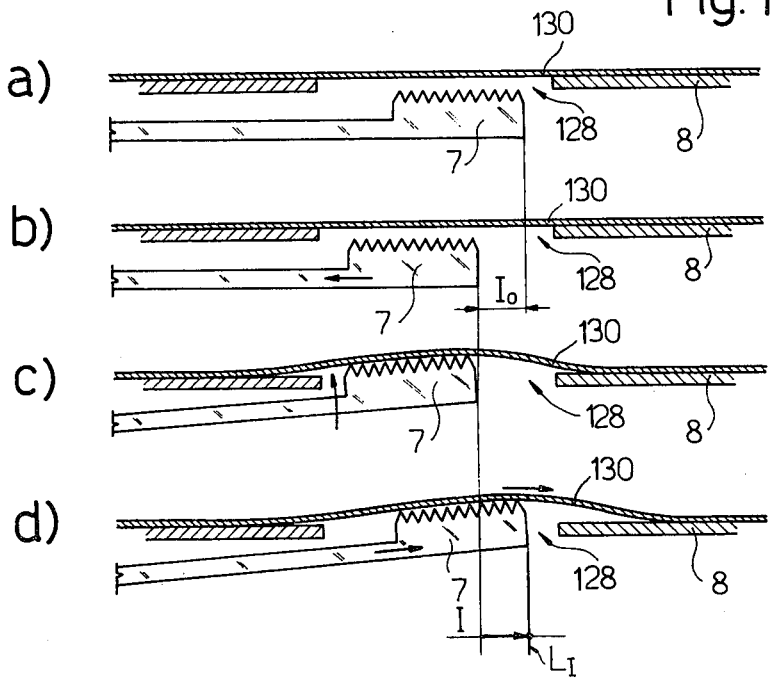

MOTION CONVERSION MECHANISM FOR EFFECTING SEWING MACHINE FEED DOG CONTROL

BACKGROUND OF THE INVENTION

This invention relates to a sewing machine, and in particular to a mechanism for controlling the movement of the fabric feed dog.

More particularly, the invention relates to a motion conversion mechanism arranged to receive movement signals generated by a decoder unit situated in said machine and comprising a first element arranged to assume a plurality of working positions and a second element arranged to assume a first or a second working position, said mechanism being arranged to convert said movement signals into movements of a feed dog for the fabric, in such a manner as to cause the fabric to undergo a movement, the extent of which depends on which position has been assumed by said first element, and which is in either a forward or a backward direction depending upon whether the first or second working position has been assumed by said second element.

Motion conversion mechanisms of the aforesaid type which are known at the present time have certain drawbacks. Firstly, they are of low precision such that the transfer of movement from the decoder unit to the dog is excessively influenced by the various couplings between the intermediate mechanical members, with consequent inaccuracy in the positioning of the dog. A drawback of this type is particularly felt when the sewing machine is set for embroidery work, the result being that lack of uniformity is noted in the distribution of the stitches, caused by imperfect transfer of the movement commands for the dog. Such a drawback is most greatly felt when fabrics are to be sewn which do not respond in the same manner when subjected to forward and backward dragging movements by the dog. For example, if a button-hole is to be made, the number of stitches required for sewing one edge is not equal to the number of stitches in the opposite direction required for sewing the opposite edge, so that in the case of sewing machines which automatically sew the button-hole, the button-hole remains incomplete and the operator has to operate the machine manually in order to correctly finish the sewing operation.

SUMMARY OF THE INVENTION

The object of the present invention is to provide a mechanism for controlling the movement of a sewing machine dog which is free from the aforesaid drawbacks of known mechanisms.

Said object is attained according to the present invention by a sewing machine comprising a conversion mechanism which receives movement signals generated by a decoder unit situated in said machine, and is provided with a first element arranged to assume a plurality of working positions, and a second element arranged to assume a first or a second working position, said mechanism being arranged to convert said movement signals into movements of a feed dog for the fabric in such a manner as to cause said fabric to undergo a movement, the extent of which depends on which position has been assumed by said first element, and which is in either a forward or backward direction depending upon whether the first or second working position has been assumed by said second element, characterised in that said motion conversion mechanism comprises:

a plurality of levers equal in number to the number of said plurality of working positions which can be assumed by said first element, each lever being arranged to assume a rest position or a working position;

a selector unit controlled by said first element and arranged to select one of said levers and to move said selected lever into said working position;

a member angularly coupled to a control shaft for said dog and arranged to be prepositioned in a predetermined angular position by said selected lever; and a dragging element controlled by said second element of said decoder unit and arranged to engage said member in such a manner as to move this latter from said predetermined angular position towards an angular reference position.

BRIEF DESCRIPTION OF THE DRAWINGS

The present invention will be more apparent from the description of a preferred embodiment given hereinafter by way of non-limiting example with reference to the accompanying drawings in which:

FIGS. 2, 3, 4, 5, 6, 7, 8 and 9 are views of certain details of the machine of FIG. 1;

FIG. 10 shows the pattern of movements in the vertical direction "v" (FIG. 10*a*) and longitudinal direction "l" (FIG. 10*b*) of the feed dog of the machine of FIG. 1; and FIGS. 11*a–d* and 12*a–d* show the main stages in the movements of said dog in the case of a forward and backward fabric movement command respectively.

DETAILED DESCRIPTION OF THE INVENTION

Figure 1:
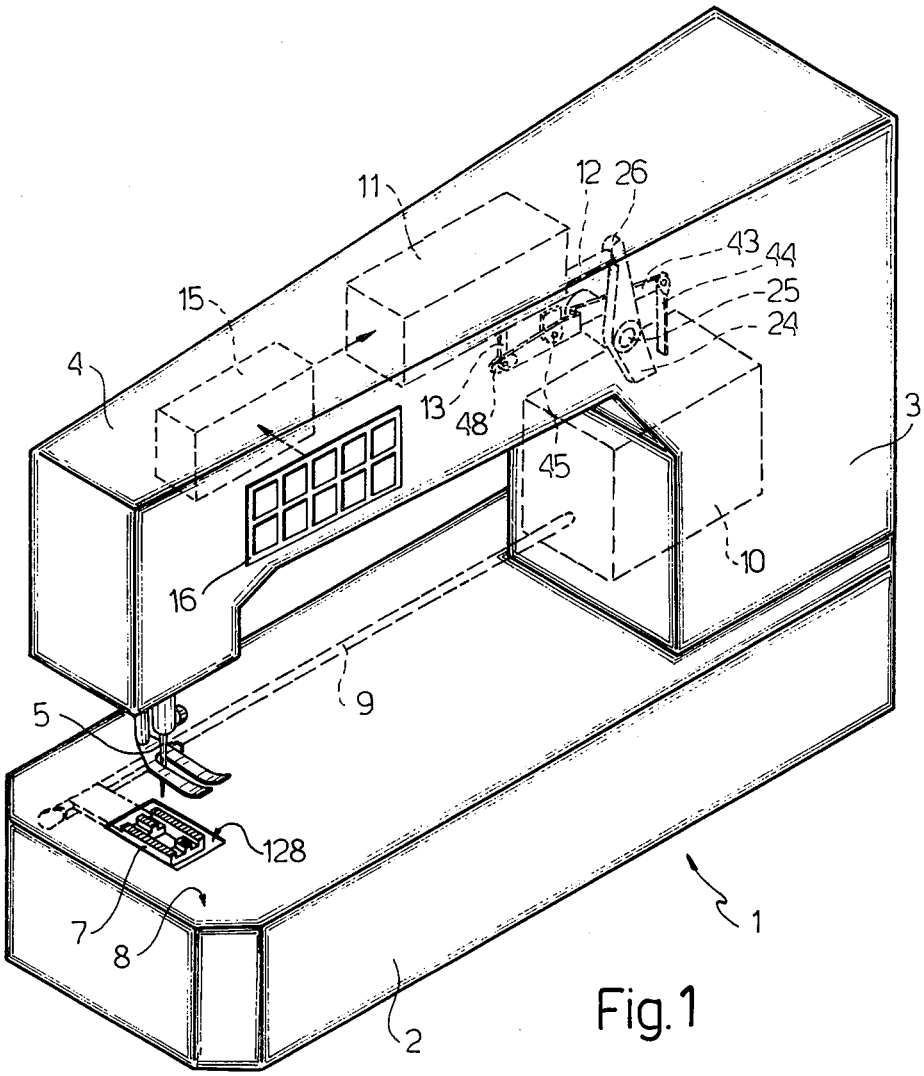
FIG. 1 is a perspective view of a sewing machine constructed in accordance with the present invention.

In FIG. 1, the reference numeral 1 indicates overall a sewing machine comprising a base 2 and a support column 3, from which there extends an arm 4 supporting a needle 5. The machine 1 comprises a feed dog 7 which is mobile relative to the sewing plate 8 of the base 2, and is supported at one end by a shaft 9 arranged to rotate about its axis such as to cause said dog 7 to make a longitudinal movement in a forward or backward direction. The other end of the shaft 9 is connected to the exit of a motion conversion mechanism 10 illustrated in greater detail in FIGS. 2 to 9.

The mechanism 10 is arranged to receive movement signals generated as output by a decoder unit 11 housed in the arm 4 and comprising a rod 12 arranged to assume a plurality of working positions, and a rod 13 arranged to assume a first or a second working position. More particularly, the decoder unit 11 is substantially an electromechanical decoder which receives an electrical signal from a processing unit 15 and converts this signal into a corresponding movement of the rods 12 and/or 13, so as to cause the former (12) to assume a plurality of different longitudinal positions, and the latter (13) to assume a rest or working position, such that this latter is either partly retained inside the unit 11 or is urged to the outside of it respectively (see FIG. 2). The processing unit 15 comprises a plurality of memories and general electronic control circuits for the decoder unit 11, each of which can be selected by the operator from the keyboard 16.

Figure 2:
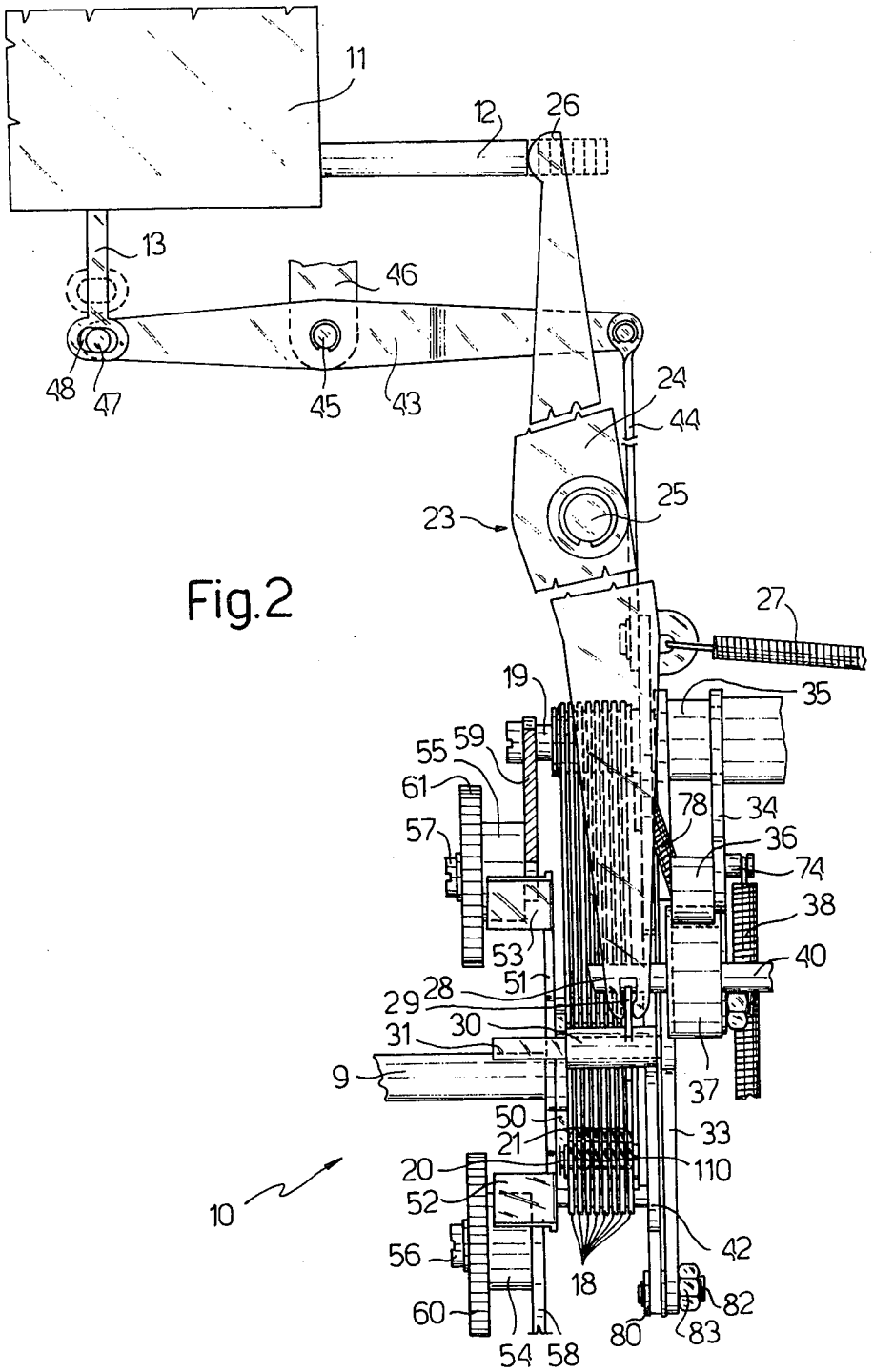

With particular reference to FIG. 2, the motion conversion mechanism 10 comprises substantially a plurality of levers 18 equal in number to the number of said plurality of working positions which can be assumed by the rod 12 of the decoder unit 11. Each lever 18 has a first end mounted rotatable about a support pin 19, its other end resting on a peg 20 disposed transversely to the levers 18. The peg 20 comprises a plurality of radial rings 21 spaced apart axially, and a respective lever 18 can be housed in the space between two adjacent rings.

The mechanism 10 also comprises a selector unit 23 substantially constituted by a rocker lever 24 pivoted on a pin 25 and comprising a first end 26 which is kept constantly urged against the end of the rod 12 by the action of a return spring 27. The other end of the rocker lever 24 is of fork configuration, indicated by 28, and engages an appendix 29 extending radially from a tubular member 30 which is axially slidable on a support pin 31 of square cross-section.

The device 10 also comprises a lever 33 which supports said pin 31 and has one end mounted rotatably about the pin 19, together with a further lever 34 and an interposed spacer 35. The lever 34 carries at one end a roller 36 which is urged into cooperation with the surface of a cam 37 by the elastic action exerted by a spring 38 acting on the lever 34. Finally, the cam 37 is keyed on to a shaft 40 which, in a manner not shown, receives its motion from the drive motor for said sewing machine 1.

The motion conversion mechanism 10 comprises a dragging element 42 arranged to move substantially parallel to each lever 18 under the action of a rocker arm 43, to one end of which it is connected by means of a rod 44. The rocker arm 43 is mounted rotatable about a pin 45 connected to a fixed part 46 of the sewing machine, its other end comprising a pin 47 slidable in a slot 48 located at the end of the rod 13 of the decoder unit 11.

Finally, the motion conversion mechanism 10 comprises a rocker arm 50 (better seen in FIGS. 5, 6 and 8) disposed below the levers 18 and angularly coupled to the shaft 9 which controls the movements of the dog 7, and an auxiliary rocker arm 51 also angularly coupled to the shaft 9. the auxiliary rocker arm 51 comprises at its opposing ends two bent lugs 52, 53 arranged to cooperate with two stop rollers 54, 55 respectively, mounted eccentrically on respective pins 56, 57. These latter are connected to fixed parts 58, 59 of the frame of said sewing machine. The axial position of each roller 54, 55 relative to its pin can be adjusted by the operator by means of two discs 60, 61 facing the respective rollers 54, 55 and accessible to the operator.

The structure of each of the constituent parts of the mechanism 10, which is illustrated diagrammatically in FIG. 2, is described in detail hereinafter with particular reference to FIGS. 3 to 8.

Figure 3:
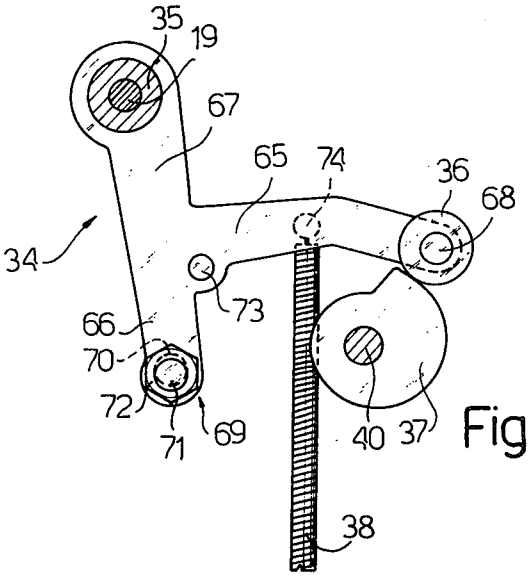
Figure 6:
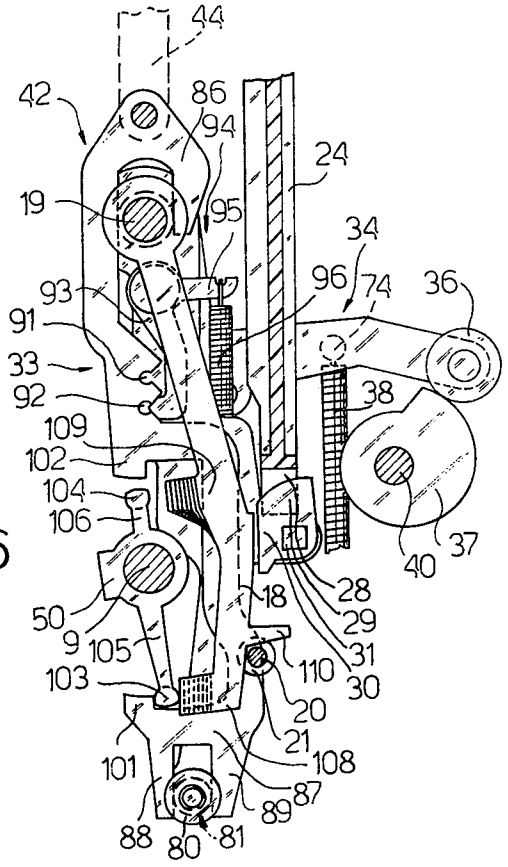

FIG. 3 shows the lever 34, comprising two arms 65, 66 extending in the form of a V from a single common part 67. The end of this latter is rotatable about the pin 19 as stated, the arm 65 carries the roller 36 at its end on a pin 68, and the end of the arm 66 has screwed into it a pin 69 which is substantially constituted by two non-aligned threaded shanks 70, 71 between which there is disposed a hexagonal connection nut 72. A peg 73 is disposed in the connection zone between the arms 65 and 66, and a further peg 74 located on the arm 65 has one end of the spring 38 hooked thereto.

Figure 4:
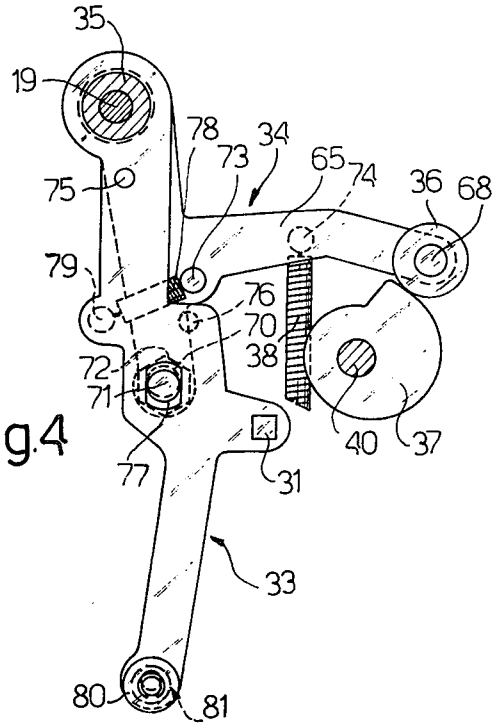

As shown in FIG. 4, on the lever 34 there is mounted the lever 33, which comprises a substantially rectangular slot 77 disposed in a position corresponding with the pin 71 of the lever 34 such that when the nut 75 is rotated, the relative angular position of the levers 33 and 34 can be adjusted within a few degrees. A spring 78 is provided for this purpose, its ends being connected respectively to the peg 73 disposed on the lever 34 and to a peg 79 carried by the lever 33. This latter also supports a pin 80 and a peg 81, the purpose of which is described hereinafter with reference to FIG. 5.

Figure 8:
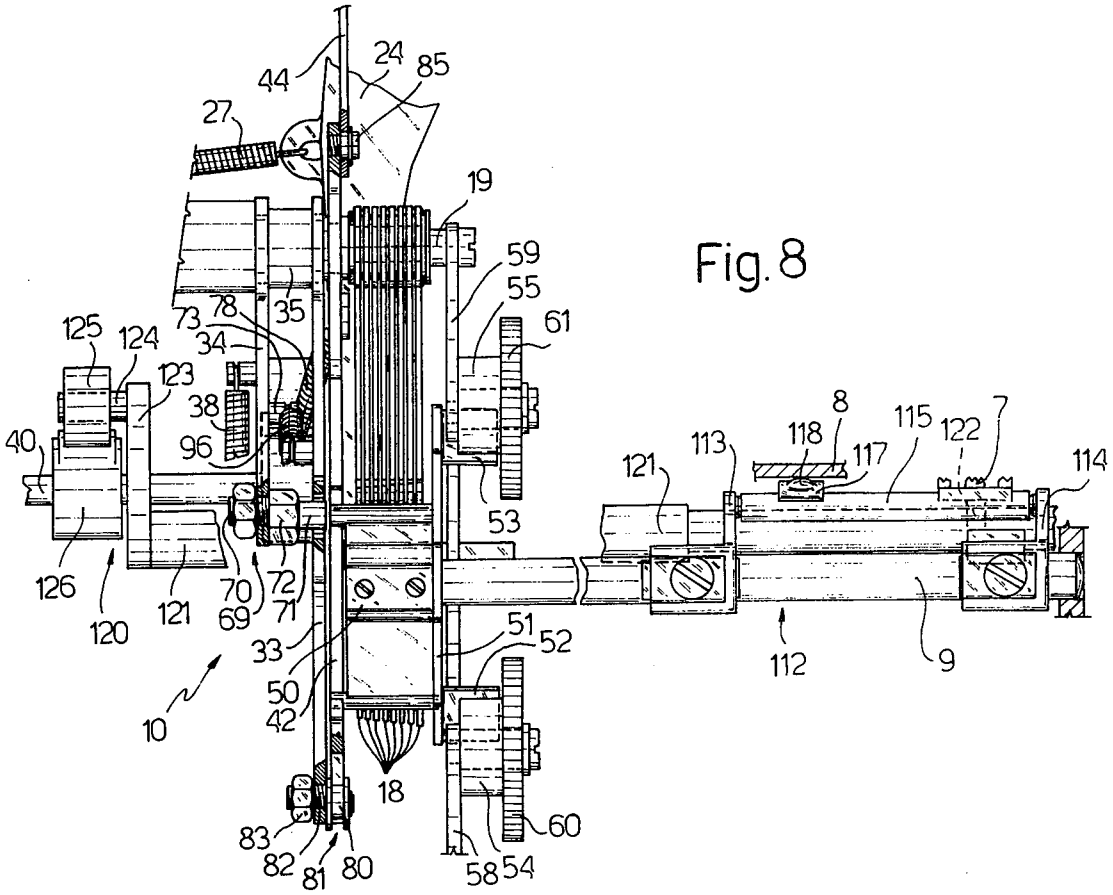

With reference to FIGS. 4 and 8, at that end of the lever 33 distant from the end rotatable about the pin 19, there is fixed a roller 80 which comprises an annular and radial groove 81 and is fixed to the lever 33 by means of a threaded shank 82 on which it is mounted eccentrically, and a nut 83 (see FIG. 8).

Figure 5:
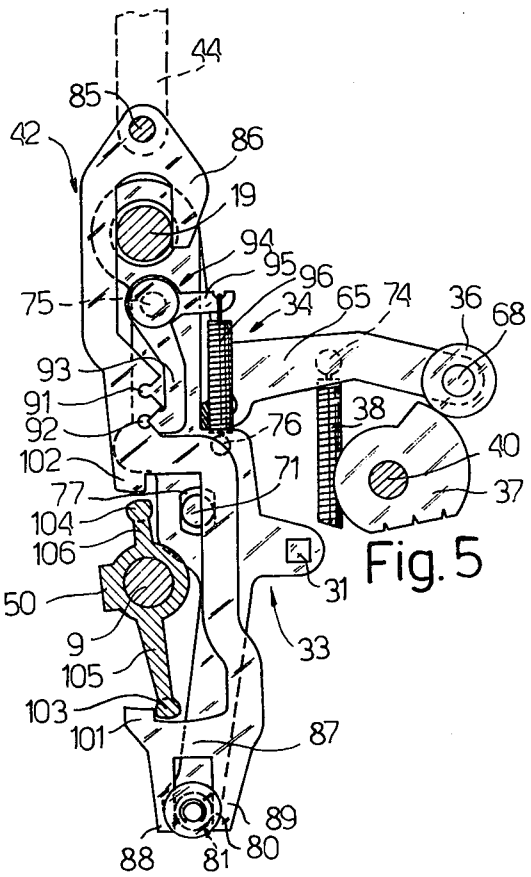

With particular reference to FIG. 5, the dragging element 42 is substantially of S configuration, and is connected to the rod 44 by means of a pin 85. In said connection zone, the element 42 has a U-bent end 86 defining two opposing surfaces arranged to slide on the pin 19, which in this manner acts as a guide for the movements of the element 42. The other end, 87, of the element 42 is in the form of a fork which defines two appendices 88, 89, of which the facing surfaces are arranged to slide in the groove 81 of the roller 80, which in this manner also acts as a guide for the element 42.

In the zone in proximity to the element 86, the element 42 comprises a pair of notches 91, 92, each of which is arranged for snap-engagement by the end of an arm 93 of a bell crank lever 94. This latter is mounted rotatable about the pin 75 carried by the lever 33, and has an arm 95, the end of which is connected to the peg 76 of said lever 33 by means of a spring 96. In the zone between the notches 91, 92 and the end 87, the element 42 comprises a concavity in which said rocker arm 50 is disposed, and at the other end comprises two facing teeth 101, 102 spaced apart by a distance slightly greater than the distance between two opposing end teeth 103 and 104 respectively of arms 105 and 106 of the rocker arm 50. In particular, the distance between the teeth 101 and 102 of the element 40 is such that when one of them, for example the tooth 101, engages the respective tooth 103 of the rocker arm 50, the other tooth (102) of the element 42 does not interfere with the respective facing tooth (104) of said rocker arm 50.

FIG. 5 shows the structure of each of the levers 18, each of which is provided in particular with an end tooth 108 and an intermediate tooth 109 arranged to cooperate respectively with the end teeth 103 and 104 of the rocker arm 50. The length of the intermediate tooth 109 of the eight levers indicated by 18 increases by a predetermined quantity for each lever, and correspondingly the length of the end tooth 108 decreases by the same quantity. Finally, each lever 18 has a respective tooth 110 arranged to be constantly guided between two facing discs of said discs 21 carried by the stop peg 20, in order to prevent undesirable transverse movements of the respective lever 18 (see also FIG. 2).

Figure 7:
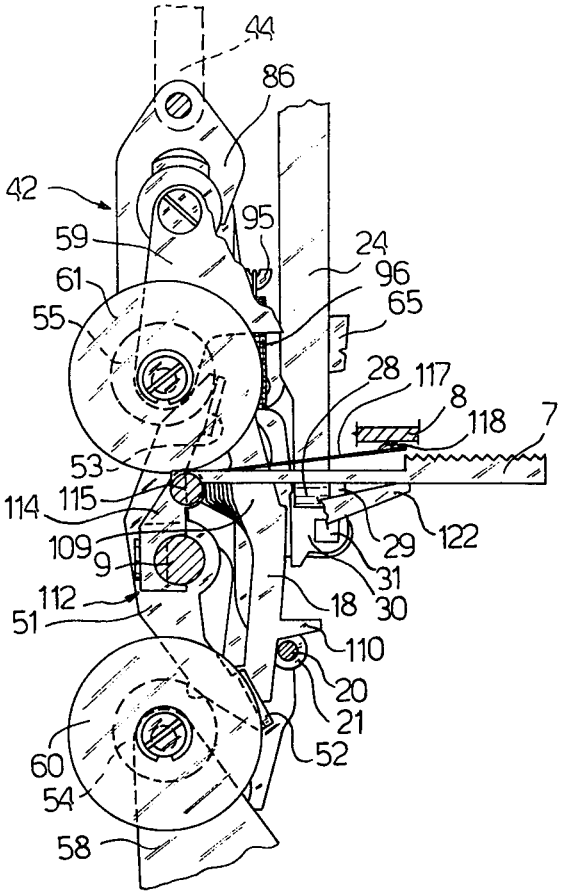

With particular reference to FIGS. 7 and 8, the shaft 9 supports the dog 7 substantially in known manner by means of a crank mechanism 112 comprising substantially two crank arms 113, 114 which at their ends support a shaft 115 rotatable about its axis. The shaft 115 has connected to it both the dog 7 and a strong resilient lamina 117 mounted radially to the shaft 115 and having an end 118 which rests on the lower surface of the sewing plate 8 in order to transmit to the shaft 115 a twisting moment which prevents the dog 7 from rising arbitrarily from its rest position.

Finally, in FIGS. 7, 8 and 9 the reference numeral 120 indicates a mechanism of known type arranged to control the cyclic raising of the dog 7 during a sewing cycle. The mechanism 120 comprises substantially a shaft 121 which at a first end carries a radial arm 122 cooperating with the lower surface of the dog 7, and at its other end carries a radial arm 123 on which there is mounted a pin 124 rotatably supporting a roller 125. This latter rests on a cam element 126 keyed on to the shaft 20 and kept urged against said shaft by the force which the resilient lamina 117 exerts by way of the shaft 79 and dog 7 on the shaft 121 connected to the roller 125 by means of the arm 123, the dog 7 in its turn resting on the arm 122 which also extends from the shaft 121.

The pattern of movements of the dog 7 in the vertical direction (v) and in the longitudinal direction (l) are shown in FIGS. 10*a* and 10*b* respectively.

Finally, FIGS. 11 and 12 show diagrammatically the actual movements of the dog 7 which, as can also be seen in FIG. 1, is mounted in a position substantially corresponding with a slot 128 provided in the sewing plate 8. In FIGS. 11 and 12 the reference numeral 130 indicates a portion of fabric resting on the plate 8 and undergoing sewing.

In order to facilitate understanding of the operation of the various mechanisms constituting the sewing machine 1, a description will firstly be given of the method of operation of the dog 7 in relation to the fabric 130, with particular reference to FIGS. 10, 11 and 12.

In order to cause the fabric 130 to undergo forward movements (FIG. 11) or backward movements (FIG. 12), the dog 7 passes substantially through four main cyclic stages (a, b, c, d). Stage "a" (see FIGS. 11*a*, 12*a*) is substantially a rest stage in which the dog 7 is lowered relative to the sewing plate 8 and assumes a rest position in the longitudinal direction which depends on the last position assumed in the previous cycle.

Stage "b" (FIGS. 11*b*, 12*b*) is a positioning stage, in which the dog 7, still lowered relative to the plate 8, is caused to undergo a longitudinal movement (Ao, Io) of predetermined value relative to the position assumed during stage "a."

Stage "c" FIGS. 11*c*, 12*c*) is a stage in which the fabric 130 becomes engaged by the dog. During this stage, the dog 7 moves only vertically. The dog 7 and fabric 130 are therefore in close contact, and the fabric 130 (still at rest) itself substantially provides for maintaining the dog 7 in its assumed longitudinal position.

Stage "d" (FIGS. 11*d* and 12*d*) is a stage in which the fabric 130 is fed, during which the dog 7, which is raised relative to the plate 8, moves towards a predetermined longitudinal reference position $L_A$ or $L_I$, to cause the fabric 130 to undergo a forward movement (A) or a backward movement (I) respectively, the extent of which depends obviously on the initial position assumed by the dog 7 during said stage "b."

Stage "d" is followed by stage "a." During stages "a" and "b," the needle 5 moves towards the fabric 130 by any known system, in a manner not illustrated.

The vertical and longitudinal movements of the dog 7 are shown in FIGS. 10*a* and 10*b* respectively. In particular, it can be seen that eight different positioning levels $l_1$, $l_2$, $l_3$, $l_4$, $l_5$, $l_6$, $l_7$, $l_8$ are provided, between two reference levels $L_I$, $L_A$.

As stated, the dog 7 is firstly positioned at one of said levels (level $l_7$ in the example), and thus when raised is moved towards the level $L_A$ or $L_I$ in order to cause the fabric 130 to undergo a longitudinal forward movement (A) or backward movement (I).

The manner in which the mechanisms constituting the machine 1 control the aforesaid movements of the dog 7 is described hereinafter with reference to FIGS. 1 to 9.

With particular reference to FIGS. 1 and 2, it will be noted that the extent of each longitudinal movement is controlled by the rod 12 of the unit 11, while its direction (forward or backward) is chosen by means of the rod 13. The rod 12 moves the tubular member or slider 30 along the pin 31 by means of the rocker lever 24, so as to position the appendix 29 at one of the eight levers 18. This operation takes place during stage "a," and the dog 7 is thus lowered and at rest.

Subsequently, (stage "b") by the effect of the cam 37 (see FIGS. 5 and 6) the lever 33 rotates clockwise about the pin 19, and, during this rotation, by means of the appendix 29 of the slider 30 urges the prechosen lever 8 until the teeth 108 and 109 of this latter touch the respective end teeth 103 and 104 of the rocker arm 50. This uniquely determines the angular position assumed by the rocker arm 50, and with it also the longitudinal position assumed by the dog 7 because this latter is connected positively to the shaft 9 (see FIG. 9) on which the rocker arm 50 is angularly mounted (see FIG. 6). During stage "b," by means of the rocker arm 43 and rod 44, the rod 13 sets the position of the dragging element 42, which can for example be the "raised" position shown in FIGS. 5 and 6.

The movement of the dog 7 during stage "c" is effected in the described manner by the dragging element 42, which although being free to slide axially guided by the pin 19 and roller 80, is angularly coupled to the lever 33 and is therefore compelled to follow the angular movements which are transmitted to this latter by the cam 37 by way of the roller 36. In particular, the dragging element 42 cooperates by means of its tooth 101 with the tooth 103 of the rocker arm 50, and thus transmits to this latter a rotation which is also transmitted to the shaft 9 and thus to the dog 7 as heretofore described. The rotation of the rocker arm 50 is halted not only by the contour of the cam 37 but also by the fact that, in the specific case considered, the lug 52 of the auxiliary rocker arm 51 cooperates with the stop roller 54 (see FIG. 7) which is conveniently constructed of elastically deformable material. As the rollers 54 and 55 are mounted slightly eccentrically relative to their respective pins 56 and 57, and because of the fact that they are able to rotate about these pins, it is possible at any time for the operator to set the reference level ($L_A$, $L_I$ in FIGS. 10, 11, 12) at which the rotation of the rocker arm 51 and consequently the movement of the dog 7 is halted.

The vertical movements of the dog 7, which are effected in known manner, are described hereinafter with reference to FIGS. 8 and 9. In particular, these movements take place against the resilient force exerted by the lamina 114, which tends to keep the dog 7 always lowered relative to the sewing plate 8. The vertical movements are cyclically controlled by the cam 126, which transmits a rotary swing motion to the shaft 121 about its axis by means of the roller 125 and arm 123 which extends from said shaft 121. This latter, by way of its arm 122, causes the dog 7 to undergo the required cyclic movements.

From an examination of the characteristics of the machine 1 according to the present invention, it is apparent that the drawbacks of the aforesaid sewing machines of known type are obviated.

In this respect, the precision with which the movement set by the decoder unit 11 and effected by the dog 7 is very high, as there is no possibility of a number of positioning errors being added together along the transmission chain. This is because in order to result in an actuation error in stage "c," a positioning error in stage "b" would have to be so large as to cause the slider 30 to make a wrong selection of the lever 18, whereas any average positioning errors upstream of the levers 18, which in any case always result in the predetermined lever 18 being chosen, are totally nullified downstream of the lever 18 itself, at which only the rocker arm 50 acts, but which is connected positively to the dog 7.

With the exception of the levers 18 and rocker arm 50, fairly large tolerances are therefore allowable in constructing the individual constituent pieces of the machine 1, with consequent undoubted advantages with regard to the final cost of the machine.

In addition, the drawback connected with the different behaviour of the fabric when being fed forwards and backwards is completely obviated. This is because by adjusting the angular position of the rollers 53 and 54 by means of the discs 61 and 60, it is now possible to finely set the reference limit ($L_A$ or $L_I$) against which the rotation of the rocker arm 50 is halted at each cycle.

Finally, it is apparent that modifications can be made to the described embodiment of the sewing machine 1 without leaving the scope of the present invention.

What I claim is:

1. A sewing machine (1) comprising a motion conversion mechanism (10) which receives movement signals generated by a decoder unit (11) situated in said machine (1), and is provided with a first element (12) arranged to assume a plurality of working positions, and a second element (13) arranged to assume a first or a second working position, said mechanism (10) being arranged to convert said movement signals into movement of a dog (7) for feeding the fabric (130) in such a manner as to cause said fabric (130) to undergo a movement, the extent of which depends on which position has been assumed by said first element (12), and which is in either a forward or backward direction depending upon whether said first or second working position has been assumed by said second element (13), characterized in that said motion conversion mechanism (10) comprises:

a plurality of levers (18) equal in number to the number of said plurality of working positions which can be assumed by said first element (12), each lever (18) being arranged to assume a rest position or a working position;

a selector unit (23) controlled by said first element (12) and arranged to select one of said levers (18) and to move said selected lever (18) into said working position;

a member (50) angularly coupled to a control shaft (9) for said dog (7) and arranged to be prepositioned in a predetermined angular position by said selected lever (18); and a dragging element (42) controlled by said second element (13) of said decoder unit (11) and arranged to engage said member (50) in such a manner as to move this latter from said predetermined angular position towards an angular reference position.

2. A machine as claimed in claim 1, characterized in that said member (50) is a rocker arm angularly coupled in a central position to said control shaft (8) for said dog (7), and each said lever (18) comprises a first and a second tooth (108, 109), each of which faces a respective end (103, 104) of a respective arm (105, 106) of said rocker arm (50).

3. A machine as claimed in claim 2, characterized in that said levers (18) have one end mounted rotatable about a support pin (19), and are disposed side-by-side.

4. A machine as claimed in claim 3, characterized in that the length of said first tooth (108) and the length of said second tooth (109) respectively increase and decrease by a predetermined amount between any one lever (18) and the next.

5. A machine as claimed in claim 3, characterized in that each said lever (18) comprises, in proximity to the end distant from the end rotatable about said pin (19), a third tooth (110) which slides between respective guide surfaces pertaining to elements (21) mounted at equal distances apart.

6. A machine as claimed in claim 5, characterized in that each said element (21) is in the form of a ring and is mounted between respective similar elements by way of spacers.

7. A machine as claimed in claim 1, characterized in that said selector unit (23) comprises a rocker lever (24) rotatable about a pin (25), and a slider (30) slidable axially on a support and guide pin (31), said rocker lever (24) having a first end (26) which cooperates with said first element (12) of said decoder unit (11), and a second end (28) which cooperates with said slider (30).

8. A machine as claimed in claim 7, characterized in that said slider (30) is substantially constituted by a tubular member of polygonal internal cross-section, and said support and guide pin (31) has a cross-section equal to said polygonal cross-section.

9. A machine as claimed in claim 2, characterized in that said dragging element (42) comprises a first and a second tooth (101, 102) arranged respectively to cause said first and said second end (103, 104) of said rocker arm (50) to rotate about said shaft (9).

10. A machine as claimed in claim 9, characterized in that said dragging element (42) is substantially of S shape and is operated by a drive (40).

11. A machine as claimed in claim 10, characterized in that said drive (40) also controls the movement of said slider (30) towards each of said levers (18).

12. A machine as claimed in claim 2, characterized by comprising means for halting the angular rotation of said control shaft (9) for said dog (7) at two opposing limiting angles.

13. A machine as claimed in claim 12, characterized in that said halt means comprises a pair of stop elements and an auxiliary rocker arm (51) having at its opposing ends a first and a second lug (52, 53), each of which is arranged to cooperate with a respective stop element.

14. A machine as claimed in claim 13, characterized in that each said stop element is constructed of elastically deformable material.

15. A machine as claimed in claim 13, characterized in that each said stop element is substantially constituted by a roller (54, 55).

16. A machine as claimed in claim 17, characterized in that each said roller (54, 55) is mounted rotatably and eccentrically on a respective pin (56, 57).

17. A machine as claimed in claim 16, characterized by comprising means for adjusting the angular position of said roller (54, 55) on said pin (56, 57).

* * * * *